US006602012B2

(12) United States Patent
Furukawa et al.

(10) Patent No.: US 6,602,012 B2
(45) Date of Patent: Aug. 5, 2003

(54) COLLECTOR TYPE WRITING INSTRUMENT

(75) Inventors: Kazuhiko Furukawa, Kanagawa (JP); Yojiro Sano, Tokyo (JP)

(73) Assignee: Mitsubishi Pencil Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/149,589

(22) PCT Filed: Dec. 15, 2000

(86) PCT No.: PCT/JP00/08920

§ 371 (c)(1),
(2), (4) Date: Jun. 14, 2002

(87) PCT Pub. No.: WO01/43985

PCT Pub. Date: Jun. 21, 2001

(65) Prior Publication Data

US 2002/0181996 A1 Dec. 5, 2002

(30) Foreign Application Priority Data

Dec. 16, 1999 (JP) ..... 11-357135

(51) Int. Cl.[7] ..... D43K 5/02
(52) U.S. Cl. ..... 401/224; 401/223; 401/227
(58) Field of Search ..... 401/223, 224, 401/225, 226, 227

(56) References Cited

U.S. PATENT DOCUMENTS 2,681,041 A * 6/1954 Zodtner et al. ..... 401/227
2,685,273 A * 8/1954 Wing ..... 401/224
4,968,169 A * 11/1990 Yokosuka et al. ..... 401/227

FOREIGN PATENT DOCUMENTS

| | | |
|---|---|---|
| JP | 63-221096 A | 9/1988 |
| JP | 63-221096 | 9/1988 |
| JP | 2-73370 U | 6/1990 |
| JP | 2-73370 | 6/1990 |
| JP | 3-31580 | 7/1991 |
| JP | 3-31581 | 7/1991 |
| JP | 9-104194 A | 4/1997 |
| JP | 2000-343877 A | 12/2000 |

* cited by examiner

*Primary Examiner*—David J. Walczak
(74) *Attorney, Agent, or Firm*—Burns, Doane, Swecker & Mathis, LLP

(57) ABSTRACT

In a free-ink type collector writing instrument, the collector is formed with a partitioning portion for substantially shutting off the ink tank from the outside air, auxiliary retaining grooves are formed on the ink tank side with respect to the air/liquid exchanger of the partitioning portion while main retaining grooves are formed on the front side with respect to the air/liquid exchanger of the partitioning portion, a wide groove formed across the auxiliary retaining grooves for connecting the air/liquid exchanger and the ink tank is formed with a narrow groove extending from the air/liquid exchanger side to the ink tank side and lateral grooves capable of leading ink into the auxiliary retaining grooves. It is further effective if the capacity 'ie' of the auxiliary retaining grooves and the capacity 'is' of the main retaining grooves are designed so as to satisfy a relation 'is>ie>0.05·is' or if effective partitioning portion grooves are formed.

11 Claims, 8 Drawing Sheets

COLLECTOR TYPE WRITING INSTRUMENT

TECHNICAL FIELD

The present invention relates to improvement of a free-ink collector type writing instrument having a point assembly as a writing portion at the tip, such as a ball-point pen, felt pen, fountain pen, etc., comprised of an ink tank for storing ink directly, a collector as an adjuster made up of multiple vanes for adjusting the internal pressure using capillary action, a means for feeding ink from the ink tank to the point assembly. The present invention particularly relates to improvement against deficiencies immediately after production and improvement of the collector in the internal pressure adjusting function to deal with change in temperature and change in pressure during use.

BACKGROUND ART

Writing instruments which have a collector disposed between a point assembly and ink tank for retaining free-state ink and regulating the pressure inside the ink tank so as to prevent ink leakage from the pen tip and ink from flooding from an air hole have been conventionally known.

There have also been known so-called sliver type pens which have a sliver of fabric bundles impregnated with a low viscosity ink of some mPa·s and an ink feed for feeding ink to their pen point. This sliver type pen, however, has the problem of ink consumption being indiscernible and the problem that an ample amount of ink flows out, and hence thick drawn lines can be obtained, in the starting stage but the flow amount gradually becomes lower, and hence the drawn lines become thinner, as the ink is used for writing. In order to smoothly deliver the ink from the sliver, the capillary capacity of the sliver may be set to be low. However, this setting will increase the occurrence of ink leakage and eruption from the sliver and smudging clothes due to impacts such as from being dropped. In contrast, if the capillary capacity of the fabric sliver is increased, there occurs an ink ejection problem in that the ink flow rate sharply lowers as the ink is used for writing and the drawn lines become considerably thin in the latter half of its life even though there is still an abundant amount of ink left.

A collector writing instrument has some advantages that it delivers ink at a flow rate equal to or above that of a sliver type writing instrument at the starting stage and will not gradually reduce its ink flow rate and is able to provide thick lines even without applying any extra writing force until its life's end, that it can be charged with a large amount of ink and that the amount of free-state ink left can be checked.

As shown in FIGS. 7 and 8, in a collector writing instrument, once air inside ink tank 3 expands or contracts due to variation of the external air in pressure or due to change in temperature, ink 2 moves between collector 6 and ink tank 3 (or air enters the tank through a narrow ink channel 14 and air/liquid exchanger 18) so as to adjust the internal pressure, whereby it is possible to prevent ink 2 from leaking out from the tip 9 of a point assembly 1. Since, if the capacity of ink tank 3 is large the expansion/contraction of the air space in tank 3 becomes large, a certain relationship has been found between the capacity of ink tank 3 and the maximum ink retention capacity of collector 6. Conventionally, there has been completed inventions and commercial products which use a collector having a capacity of about 10% or more of the ink tank capacity.

There exist some collector writing instruments which bring about a flooding problem if reduction and increase in pressure due to change in temperature, variation in pressure, change in altitude or any other change is repeated. However, conventionally, if the performance of a collector writing instrument under a temperature rise from room temperature at about 20° C. to about 50° C., which is conceivably the maximum atmospheric temperature, is validated, the writing instrument is considered as having a good performance free from problems. However, in the cases where a writing instrument which has been put under winter ambient air is carried to the front of a heater, the writing instrument will undergo a sharp temperature rise from 0° C. to 50° C. In such a case, the conventional writing instruments would cause ink flooding and other problems.

In order to solve the flooding problem, some countermeasures can be considered such as enlarging the maximum ink retention of collector 6 (making the diameter or length greater), reducing the size of ink tank 3 and other methods. However, all these methods have some drawbacks: that is, a style problem due to enlargement of the barrel size; lowering of cost performance due to reduction in ink amount and hence short life; and the problem of forward leakage being likely to occur due to a too long collector 6 or a too long distance from air/liquid exchanger 18 to tip 9 of point assembly 1 (to be called 'ink head H' hereinbelow). Alternatively, to reach a solution with ink 2, an ink 2 has to have an extremely low wetting ability, which means compromising the writing performance.

On the other hand, when a collector writing instrument which has been capped under about 1 atm. on the ground and is uncapped inside an airplane in which the air pressure is generally reduced to about 0.8 atm., the interior of the pen which has been balanced under 1 atm., is instantaneously exposed to an environment of about 0.8 atm., so ink 2 inside moves in a rush through an air groove 15 inside collector 6, whereby ink 2 floods out from an air hole 10, being unable to be properly retained by the whole part of retaining grooves 13.

In order to solve the flood problem occurring under conditions in which the air pressure varies, devices and inventions have been disclosed in Japanese Utility Model Publication Hei 3 No. 31580, Japanese Utility Model Publication Laid-open Hei 3 No. 31581 and Japanese Patent Application Laid-open Hei 9 No. 104194, and others. However, these disclosures only provide the function of slightly weakening the flush inside the collector.

A collector writing instrument is configured so that air/liquid exchanger 18 is wetted with ink 2 and ink 2 or air is replaced only through air/liquid exchanger 18 having a high enough capillarity. A collector writing instrument is one which makes use of the mechanism that the internal pressure on the ink tank 3 side is substantially reduced by the function of a meniscus formed by the capillarity of air/liquid exchanger 18 to prevent ink 2 from flowing out even when it is oriented downwards.

For this reason, it is necessary to wet air/liquid exchanger 18 near the rear end of collector 6 and partitioning portion 19 around the exchanger at almost the same time when assembled. If this wetting with ink 2 is not enough to fully create shutoff, air will flow into the ink tank 3 side other than through air/liquid exchanger 18 so that the reduction of ink tank 3 in pressure by the function of the meniscus cannot be achieved. This results in a deficiency in that the ink 2 leaks to point assembly 1 or the retaining portion of collector 6 without a break. Conventionally, impacts used to be applied immediately after assembly to wet the rear end portion, or the instrument used to be left to stand with its pen tip set downward for a certain period of time to fully wet the rear end portion. However, these production processes have so far entailed insufficiency of wetting, a necessity of long period of time in production and other drawbacks.

Enhancement of the resistance against flooding can be achieved by increasing the capacity of collector 6. However, if collector 6 is made longer to avoid the thickness problem, the ink head H applying on the point assembly becomes higher, whereby a forward leakage problem, i.e., the problem of ink 2 leaking out from point assembly 1 occurs. Therefore, it has been impossible in conventional configurations to simply make collector 6 longer to increase the capacity of collector 6.

In order to improve the resistance against flooding, the applicant hereof has made a device having a longer collector without increase in collector head. However, since this configuration has a greater area to be wetted with ink for shutoff immediately after the production of the air/liquid exchanger and its vicinity, there is a demand for a solution to the problem during manufacturing.

Further, a solution to an ink flooding problem due to a sharp variation in pressure such as on an airplane has been demanded. Especially, due to repetitions of sharp variations in pressure, ink 2 is caused to be left behind inside retention grooves 13 of collector 6 and this left ink may flood out even by a slight temperature rise or other reasons. A countermeasure against this problem is also demanded. However, there has been no proposal of collector type writing instruments which is able to meet the above demands without any compromise in other performances.

It is therefore a main object of the present invention to provide improvement of collector type writing instruments of present types, it is an object to provide a collector type writing instrument which can avoid crucial malfunctions such as pollution of consumer's clothes, by improving the prevention capability against accidents in handling of writing instruments, such as the ink leakage defect due to influence of increase and reduction in pressure inside ink tank 3 caused by temperature changes and air pressure changes, the flooding problem occurring when they have been stocked for long periods in shops, the ink forward leakage defect, the ink flooding problem during manufacturing, and other problems.

It is a further object to provide a collector type writing instrument which meets the demands for slim appearance of a collector type, which tends to become thick, without compromising the excellent writing comfort attributed to conventional collector writing instruments and without increasing its cost.

In sum, it is an object to provide a writing instrument which is free from the forward leakage problem even when the capacity of collector 6 is increased and to provide a collector type writing instrument free from the problem of ink 2 flooding when increase and reduction in pressure is repeated. In particular, it is an object to achieve a task of returning ink 2, inside collector 6, to the tank 3 side under an environment in which sharp changes in pressure occur and reach a solution to a problem of difficulties in shutting off ink tank 3 from the outside air because of unwillingness of partitioning portion 19 and air/liquid exchanger 18 to get wetted with ink during assembly due to enlargement of the areas of other parts (such as partitioning portion 19) than air/liquid exchanger 18.

DISCLOSURE OF INVENTION

The collector writing instruments of the present invention include ball-point pens which have an ink feeder portion such as an ink feeder core (center core 8 and/or collector core 7) functioning based on capillarity to assure a flow passage from an ink tank 3 to a writing point 9 provided at the tip of a point assembly 1 and felt tip pens, markers and the like of which the ink feeder core 7 or 8 itself serves as a point assembly 1. Hereinbelow, ink feeder cores (center core 8, collector core 7, etc.) will also include those which themselves serve as pen tips.

Arranged between ink tank 3 of a cup-like shape with a bottom and point assembly 1 is a collector 6*a,* which includes a vent channel 11 connected to the outside air and air grooves 15, an air/liquid exchanger 18, an elongated ink groove 14, a plurality of retaining grooves 13, 13*a,* defined as the gaps between vanes 12, 12*a,* arranged at intervals determined as appropriate, and has the function of controlling the internal pressure inside the pen body by allowing ink 2 to flow into and out of retaining grooves 13, 13*a.*

As the first means of the present invention, also-called collector type writing instrument is comprised of: a point assembly having a writing point at the front end thereof; an ink tank for storing free-state, relatively low-viscosity ink having a viscosity of 2 to 100 mPa·s at normal temperature; a feeder portion such as a center core and the like for feeding ink from the ink tank to the writing point; and a collector made up of a plurality of vane-like adjusting elements for adjusting the internal pressure of the ink tank by making use of capillary capacity and a longitudinal groove serving as an air/liquid exchanger groove and connected to the vane-like adjusting elements, and is characterized in that: the collector has a partitioning portion comprised of a frontmost partitioning portion capable of shutting off air communication between the ink tank and the outside air other than through the air/liquid exchanger, a rearmost partitioning portion and connecting partitioning portions for connection between the frontmost partitioning portion and the rearmost partitioning portion; main retaining grooves are formed from the frontmost partitioning portion toward the point assembly side; auxiliary retaining grooves are formed between the frontmost partitioning portion and the rearmost partitioning portion; air grooves connected to the outside air are formed in both the auxiliary retaining grooves and the main retaining grooves; an air/liquid exchanger and a narrow groove for leading ink to the air/liquid exchanger are formed between the frontmost partitioning portion and the rearmost partitioning portion; and lateral grooves for leading ink from the narrow groove to the connecting partitioning portions are provided.

Usually, a partitioning portion 19 is formed on the outer periphery of the collector, as shown in FIG. 8, so as to enclose the collector on the same plane that is perpendicular to the axial direction. In the present invention, instead of arranging a partitioning portion 19A on the same plane that is perpendicular to the axial direction as such, it is arranged extending partly towards the point assembly side, displacing from the outer periphery of the collector or the axial direction. The frontmost partitioning portion indicates the partitioning portion 19*c* which is the closest to the point assembly side with respect to the axial direction, and the rearmost partitioning portion indicates the partitioning portion 19*d* which is the closest to the ink tank side with respect to the axial direction. Connecting partitioning portions 19*a* are provided for connection between frontmost partitioning portion 19*c* and rearmost partitioning portion 19*d.* Formed between frontmost partitioning portion 19*c* and rearmost partitioning portion 19*d* are an air/liquid exchanger 18 and a narrow groove 21 for leading ink to the air/liquid exchanger while lateral grooves 22 for leading ink from the narrow groove 21 to connecting partitioning portions 19*a* are provided. This arrangement makes it possible to lead ink from the narrow groove to connecting partitioning portions 19*a* via the lateral grooves. As a result, the whole partitioning portion 19A including connecting partitioning portions 19*a* can be positively wetted, whereby it is possible to surely shut off the ink tank from the outside air. Further, in order to enhance wetting with ink 2, chamfers 24 may be formed near lateral grooves 22 (see FIG. 3).

When ink wets the connecting partitioning portions, the ink at the connecting partitioning portions is drawn into the auxiliary retaining grooves because the auxiliary retaining grooves themselves have capillary capacity. In sum, when the connecting partitioning portions are wetted, ink can be held within the auxiliary retaining grooves.

Accordingly, in order to lead ink into the auxiliary retaining grooves, it is not always necessary to provide partitioning portion grooves 23, which will be described later.

As the methods considered for leading ink from the connecting partitioning portions to the auxiliary retaining grooves in a more efficient manner, chamfers 24 may be formed in the connecting partitioning portions so that, when the connecting partitioning portions get wetted with ink, ink can be led into the auxiliary retaining grooves by capillary capacity. Alternatively, any shape and configuration such as grooves, cutouts, holes, gaps defined by combination of a plurality of parts, which can in essence lead ink 2 to the auxiliary retaining grooves, may be formed in the connecting partitioning portions.

The head acting on the point assembly is calculated based on the position of the air/liquid exchanger. In the present invention, the auxiliary retaining grooves are formed from this air/liquid exchanger toward the ink tank side so that ink can be retained therein. In general, increase in the ink retention of a collector may be made by increase in length of the collector, however this may be accompanied with a risk of ink leakage from the pen tip because the head also is increased. However, the arrangement of the present invention in which auxiliary retaining grooves, connecting partitioning portions and lateral grooves and the like are formed from the air/liquid exchanger toward the ink tank side makes it possible to increase the ink retention of the collector without any head increment (without increasing the risk of ink leakage from the pen tip).

As the second effective means of the present invention, collector 6*a* is comprised of conventionally known, main retaining grooves 16 having a function of internal pressure adjustment, in the front side of the collector confronting the point assembly 1 and auxiliary retaining grooves 17 at the rear of the former in order to increase the ink retention. Further, partitioning portion 19*d* and extended partitioning portion 19*e* and 19*f*, which are extended in the axial direction, are provided, whereby ink tank 3 can be virtually shut off from the outside air when both the above portions and air/liquid exchanger 18 are wetted with ink 2. Main retaining grooves 16 are disposed more frontward or closer to the point assembly 1 side, than extended partitioning portion 19*e* and 19*f* while auxiliary retaining grooves 17 are disposed around the extended partitioning portion 19*e* which is axially extended, in the circumferential direction. The part with hatching shown in FIG. 2 and air/liquid exchanger 18 are wetted with ink 2 to shut off the external air.

Further, a certain space (width) is created in an enclosed portion 19*b*, so that air bubbles arising from air/liquid exchanger 18 can easily move into ink tank 3.

Air grooves 15 connected to the outside air are formed in both auxiliary retaining grooves 17 and main retaining grooves 16 while a narrow groove 21 and lateral grooves 22 which lead ink 2 from the narrow groove to auxiliary retaining grooves 17 which are connected to extended partitioning portion 19*e* that is extended axially are formed in enclosed portion 19*b*. Further, air/liquid exchanger 18 is provided. Lateral grooves 22 may be formed by any shape and configuration such as grooves, cutouts, holes, gaps defined by combination of a plurality of parts, which can in essence lead ink 2 as long as they can provide the function of creating communication of ink 2 led through narrow groove 21 from the ink tank side 3 with extended partitioning portion 19*e* that is axially extended and auxiliary retaining grooves 17.

Partitioning structure 19 is usually formed on the outer periphery of the collector as shown in FIG. 8, so as to enclose the outer periphery of the collector on the same plane that is perpendicular to the axial direction. Extended partitioning portion 19*e* and 19*f* will be described. The extended partitioning portion refers to the portion which are extended partly towards the point assembly side, displacing from the outer periphery of the collector, as will be described in the embodiment hereinbelow.

The way of extension should not be limited to the approximately square bracket-shaped configuration shown in the present embodiment, but semicircular, semi-elliptic, trapezoidal, inverted trapezoidal, V-shaped and other configurations may be employed.

The enclosed portion refers to the portion enclosed by extended partitioning portion 19*e* and 19*f*.

As air/liquid exchanger 18 is formed in enclosed portion 19*b* defined by extended partitioning portion 19*e* and 19*f*, a certain space (width) needs to be formed into enclosed portion 19*b* in order to permit air bubbles arising from the air/liquid exchanger to move into the ink tank. Since the size of air bubbles arising from an air/liquid exchanger depends on the size of the air/liquid exchanger, it should be determined appropriately depending on the size of the air/liquid exchanger.

When ink wets the extended partitioning portion, the ink in extended partitioning portion 19*e* that is axially extended is drawn into auxiliary retaining grooves 17 because the auxiliary retaining grooves 17 themselves, which are arranged around extended partitioning portion 19*e* in the circumferential direction, have capillary capacity. Therefore, when the extended partitioning portion 19*e* gets wetted, ink can be held within auxiliary retaining grooves 17.

As the methods considered for leading ink from the extended partitioning portion 19*e* to the auxiliary retaining grooves in a more efficient manner, chamfers may be formed in the extended partitioning portion 19*e* so that, when the extended partitioning portion 19*e* is wetted with ink, ink can be led into the auxiliary retaining grooves by capillary capacity. Alternatively, any shape and configuration such as grooves, cutouts, holes, gaps defined by combination of a plurality of parts, which can in essence lead ink 2 to the auxiliary retaining grooves, may be formed in extended partitioning portion 19*e* and 19*f*.

The head acting on the point assembly is calculated based on the position of the air/liquid exchanger. Also in the present invention, the auxiliary retaining grooves are formed from this air/liquid exchanger toward the ink tank side so that ink can be retained therein. In general, increase in the ink retention of a collector may be made by increase in length of the collector, however this may be accompanied with a risk of ink leakage from the pen tip because the head is also increased. However, the arrangement of the present invention in which auxiliary retaining grooves, partitioning portions and lateral grooves and the like are formed from the air/liquid exchanger toward the ink tank side makes it possible to increase the ink retention of the collector without any head increment (without increasing the risk of ink leakage from the pen tip).

The other components used here may employ conventionally publicly known items. For example, as ink 2, a pseudo-plastic ink (also called gel ink) which has a low (or medium) viscosity of 2 to 100 mPa·s at normal temperature (about 23° C.) and presents a rather high viscosity in the static state so as to prevent forward leakage of ink 2 from tip 9 and lowers its viscosity when affected by shearing force or movement while writing so as to enable smooth writing, may be used by modifying it to have a lower viscosity to some degree. Also, various types of publicly known inks using pigments or dyes, which are applicable to collector writing instruments can be appropriately used as ink 2. Similarly, for other components, conventionally used items can be selected as appropriate, such that center core 8 and collector core 7 (these may be used to serve as a writing point in the case of a felt pen or marker) may be of a fiber bundle core made up of fabric threads shaped by heat or adhesives, of a so-called plastic core formed by extrusion molding having a snow-crystal section, of a sintered core made up of small particles with pores therein, thermally fixed or bonded with adhesives, or of a sponge, as long as it is capable of holding and leading ink to a certain degree or more.

The third effective means of the present invention is characterized in that the connecting partitioning portions or the extended partitioning portion has partitioning portion grooves connected to the auxiliary retaining grooves so that the narrow groove, lateral grooves, partitioning portion grooves and auxiliary retaining grooves permit ink to communicate among themselves.

Since connecting partitioning portions 19*a* or extended partitioning portion (19*e*, 19*f*) is formed with partitioning portion grooves connected to the auxiliary retaining grooves so that the narrow groove, lateral grooves, partitioning portion grooves and auxiliary retaining grooves permit ink to communicate between themselves, when a change in internal pressure inside the ink tank occurs, ink is able to smoothly flow from the ink tank to the auxiliary retaining grooves or from the auxiliary retaining grooves to the ink tank, because ink flows not only through connecting partitioning portions 19*a* and extended partitioning portion 19*e* and 19*f*, but also through the partitioning portion grooves.

The fourth effective means of the present invention is characterized in that the vertical sectional area of each partitioning portion groove (cut in the longitudinal direction of the writing instrument) is equal to or smaller than the cross-sectional area of the air/liquid exchanger (sliced along the diametric direction of the writing instrument), and the total of all the vertical sectional areas of the individual partitioning portion grooves is designed to be greater than the cross-sectional area of the air/liquid exchanger.

The vertical sectional area of each partitioning portion groove indicates the area of each partitioning portion groove when the partitioning portion groove is cut by a plane including the axis of the writing instrument.

The cross-sectional area of the air/liquid exchanger indicates the area of the air/liquid exchanger, sliced by a plane perpendicular to the axial direction of the writing instrument.

Since the vertical sectional area of each partitioning portion groove is made equal to or smaller than the cross-sectional area of the air/liquid exchanger, there is difference in capillary capacity produced by ink meniscus between each partitioning portion groove and the air/liquid exchanger. In this case, the capillary capacity generated by each partitioning portion groove is greater. Therefore, air replacement occurs at the air/liquid exchanger during writing and hence it is possible to prevent occurrence of air replacement through each partitioning portion groove. Further, since the total of all the vertical sectional areas of the individual partitioning portion grooves is designated to be greater than the cross-sectional area of the air/liquid exchanger, the flow passage into the auxiliary retaining grooves is greater than the flow passage of the air/liquid exchanger, whereby, when air inside the ink tank expands, it is possible to flow ink into the auxiliary retaining grooves by way of the partitioning portion grooves, more easily than ink flows to the air/liquid exchanger.

The fifth effective means of the present invention is characterized in that the lateral grooves and auxiliary retaining grooves are formed so as to have approximately the same width with respect to the longitudinal direction of the writing instrument.

Since the lateral grooves and auxiliary retaining grooves are formed so as to have approximately the same width, in both cases where ink flows into the auxiliary retaining grooves upon increase in pressure inside the ink tank and where ink returns from the auxiliary retaining grooves into the ink tank upon reduction in pressure inside the ink tank, ink can smoothly flow (if they have different groove widths, ink flows more easily in one direction than in the other direction). Accordingly, it is possible to establish a more efficient ink communication between the auxiliary retaining grooves and the ink tank.

The sixth effective means of the present invention is characterized in that the maximum ink retention 'ie' of the auxiliary retaining grooves and the maximum ink retention 'is' of the main retaining grooves are designed so as to satisfy a relation 'is>ie>0.05·is'.

The sixth effective means of the present invention is featured by that the maximum ink retention 'ie' of auxiliary retaining grooves 17 and the maximum ink retention 'is' of main retaining grooves 16 are designed so as to satisfy a relation 'is>ie>0.05·is' (preferably '0.3·is>ie>0.1·is').

The dimensions of main retaining grooves 16, such as the length, capacity and the like, are in effect determined by ink head H, the size of air/liquid exchanger 18 (vertical groove width and hole size) and the capacity of ink tank 3. When the outside diameter of collector 6 is assumed, as is usual, to be uniform, the summation of the axial lengths of auxiliary retaining grooves 17 should be smaller than the summation of the axial lengths of main retaining grooves 16 and should be set to be equal to or greater than 5% of the summation of the axial lengths of main retaining grooves 16.

BEST MODE FOR CARRYING OUT THE INVENTION

Figure 1:
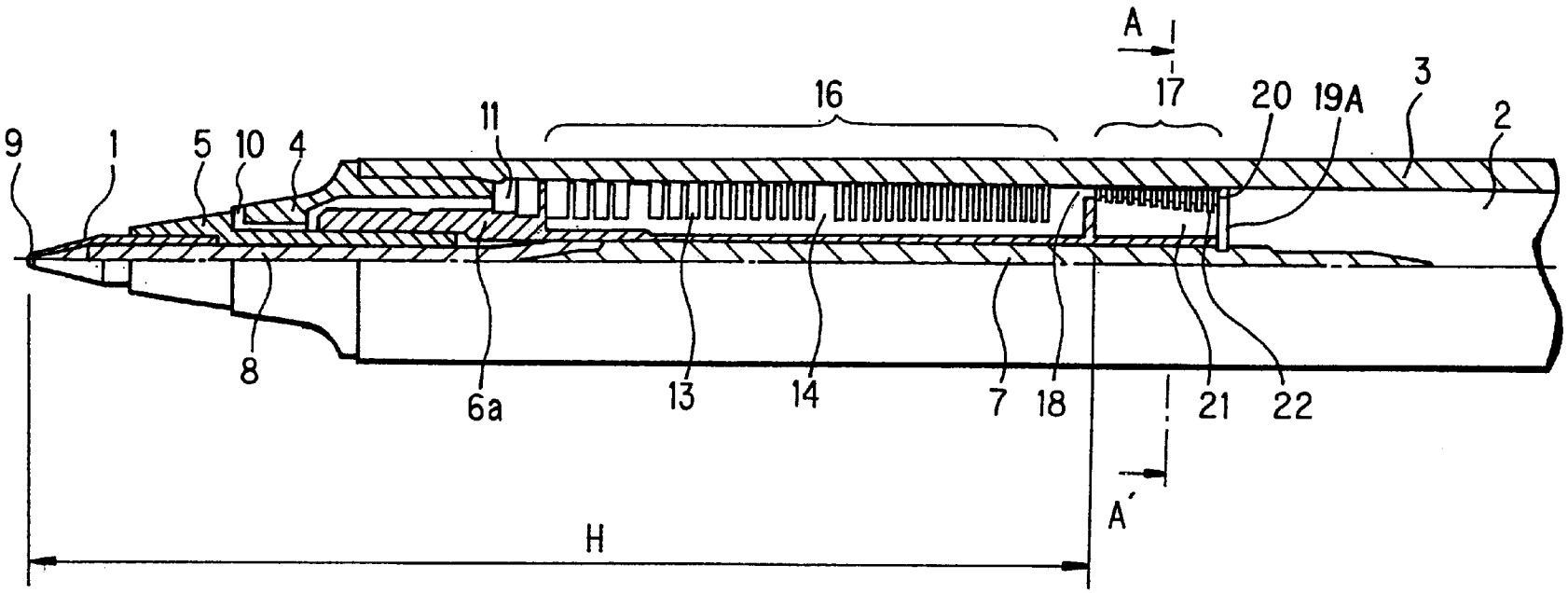
FIG. 1 is a partly sectional vertical view showing a writing instrument body according to the embodiment of the present invention.

Next, a collector type writing instrument according to the embodiment will be described with reference to the drawings.

FIGS. 1 to 6 show a collector type roller ball-point pen as an example of the present invention and a collector 6*a* as its main part. Here, the same components as those described above are allotted with the same reference numerals without description.

A typical collector type writing roller ball-point pen has a point assembly 1 which idly holds a writing ball 9 disposed at its tip in such a manner it is rotatable and will not fall off while ink 2 is led from an ink tank 3 to ball 9 by way of a collector core 7 and a center core 8. Hereinbelow, ink feeder cores (center core 8, collector core 7, etc.) will also include those which themselves serve as pen tips.

Collector 6*a* is formed with auxiliary retaining grooves 17 on the ink tank 3 side with respect to an air/liquid exchanger 18. Concerning the other components such as a plastic mouthpiece 5, joint 4 and the like for creating an air cannel 10 between point assembly 1 and collector 6*a* and for color indication, items having the same configurations as those in the conventional products may be selected and used as appropriate.

Ink tank 3 which is made up of a transparent or translucent synthetic resin and directly stores therein a relatively low-viscosity ink 2 containing more than 40% water or a solvent as its base and having a viscosity of 2 to 100 mPa·s at normal temperature, has collector 6*a* fixed therein by press fitting.

Concerning ink 2, there are dye inks which are soluble in a main solvent, pigments such as carbon black and pseudo-organic pigments such as dye resin powders as coloring agents that present beneficial water resistance and light resistance, and pigment inks in which metallic powders such as aluminum etc., are dispersed. Ink 2 used in the conventional collector type writing implements can also be used. The ink is not particularly limited in the present invention. An ink 2 containing organic solvents such as alcohols, xylene, etc., as the main solvent may be applied to the present invention as long as it can provide the functions of a collector type writing implement.

Particularly, when ink has been used by ink consumption for writing so that the amount of ink 2 left in ink tank 3 is slightly greater than the amount of the maximum retention of collector 6, expansion and contraction of air inside ink tank 3 becomes large, hence if a change of the internal pressure in ink tank 3 due to variation in atmospheric pressure or due to variation in temperature occurs, ink 2 may leak out from tip 9 of point assembly 1 or air may enter through tip 9 to cause ink starving.

Figure 7:
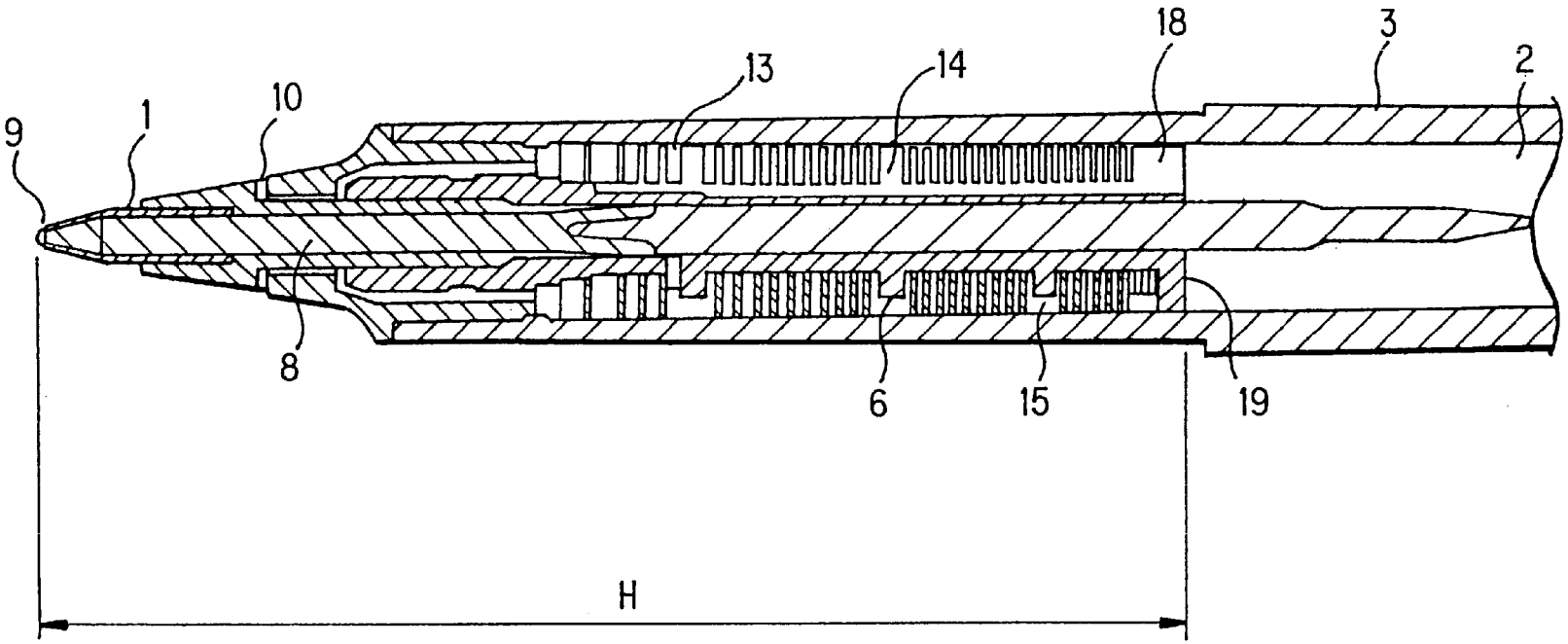
FIG. 7 PRIOR ART
FIG. 7 is vertical sectional view showing a conventional collector type writing instrument.
Figure 8:
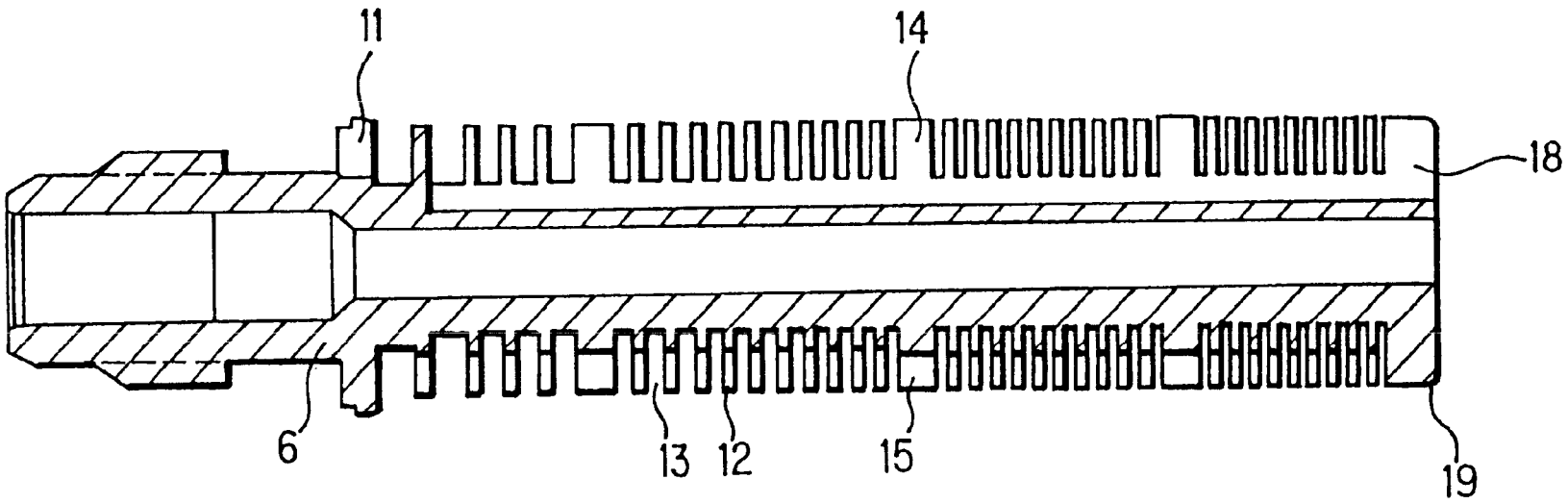
FIG. 8 PRIOR ART
FIG. 8 is a vertical sectional view showing a conventional collector 6.

In order to prevent these deficiencies, in the conventional collector 6 shown in FIG. 7, communication between the interior of the barrel (ink tank 3) and the outside of the writing instrument is established by providing a fine enough longitudinal groove 14 forming air/liquid exchanger 18 (when air/liquid exchanger 18 is integrally formed with longitudinal groove 14), air grooves 15 and retaining grooves 13 defined as gaps between multiple vanes 12. Collector 6 has the function of keeping the balance of the internal pressure when a difference in pressure occurs between the atmosphere and the interior arises, by allowing ink 2 or air from the outside to enter vane-formed retaining grooves 13 of collector 6 so as to vary the air volume inside the pen body.

In collector 6*a* of the present invention, the total volume of ink 2 to be held in the space of main retaining grooves 16 was specified at 15% (retention ratio) of the capacity of ink tank 3 (preferably 10% to 30%). The dimensions of collector 6*a* as well as the groove width etc., may be specified as appropriate depending on ink 2 used, the capacity of ink tank 3 and other factors. The greater the size of collector 6*a,* the more the safety is improved. However, with enlargement of the collector, the whole size of the pen becomes large and the volume of ink 2 relatively lowers compared to the size of the whole pen body. Therefore, the collector should be designed to a certain optimal size.

As the arrangement of the present invention, conventionally known, main retaining grooves 16 having an internal pressure adjustment function is arranged on the point assembly 1 side with respect to collector 6*a* while a partitioning structure 19A with auxiliary retaining grooves 17 is arranged at the rear of the main grooves in order to increase the amount of ink to be retained.

In general, main retaining grooves 16 are constructed so that retaining grooves 13 defined as the gaps between a plurality of fin-like vanes 12 are arranged at appropriately selected intervals while narrow longitudinal groove 14 connected to (or formed in the same shape as) air/liquid exchanger 18 is connected to each retaining groove 13 so that ink 2 can be retained or balanced by capillarity.

Partitioning portion 19A has extended partitioning portion 19*e* and 19*f* extended at least partly towards the point assembly side.

A number of fin-like vanes 12*a* protruding upright like flanges are formed at regular intervals on the outer peripheral surface in the range of auxiliary retaining grooves 17 and define retaining grooves 13*a* by the gaps therebetween. In the present embodiment, six vanes 12*a* are provided at regular intervals, constituting auxiliary retaining grooves 17.

Partitioning portion 19A and air/liquid exchanger 18 (groove or hole) is wetted with ink 2 so that the interior of ink tank 3 is substantially shut off from the external air. For air replacement, air/liquid exchanger 18 alone serves for air replacement.

Partitioning portion 19A may be formed by a part or combination of parts having no intentional grooves or holes. Alternatively, the partitioning structure may be formed with a part or parts having fine grooves or holes, as long as their dimensions are small enough compared to the dimensions of air/liquid exchanger 18, so that once the parts have got wetted with ink 2 no air replacement will be permitted therethrough or substantial confinement can be assumed to be established.

Figure 2:
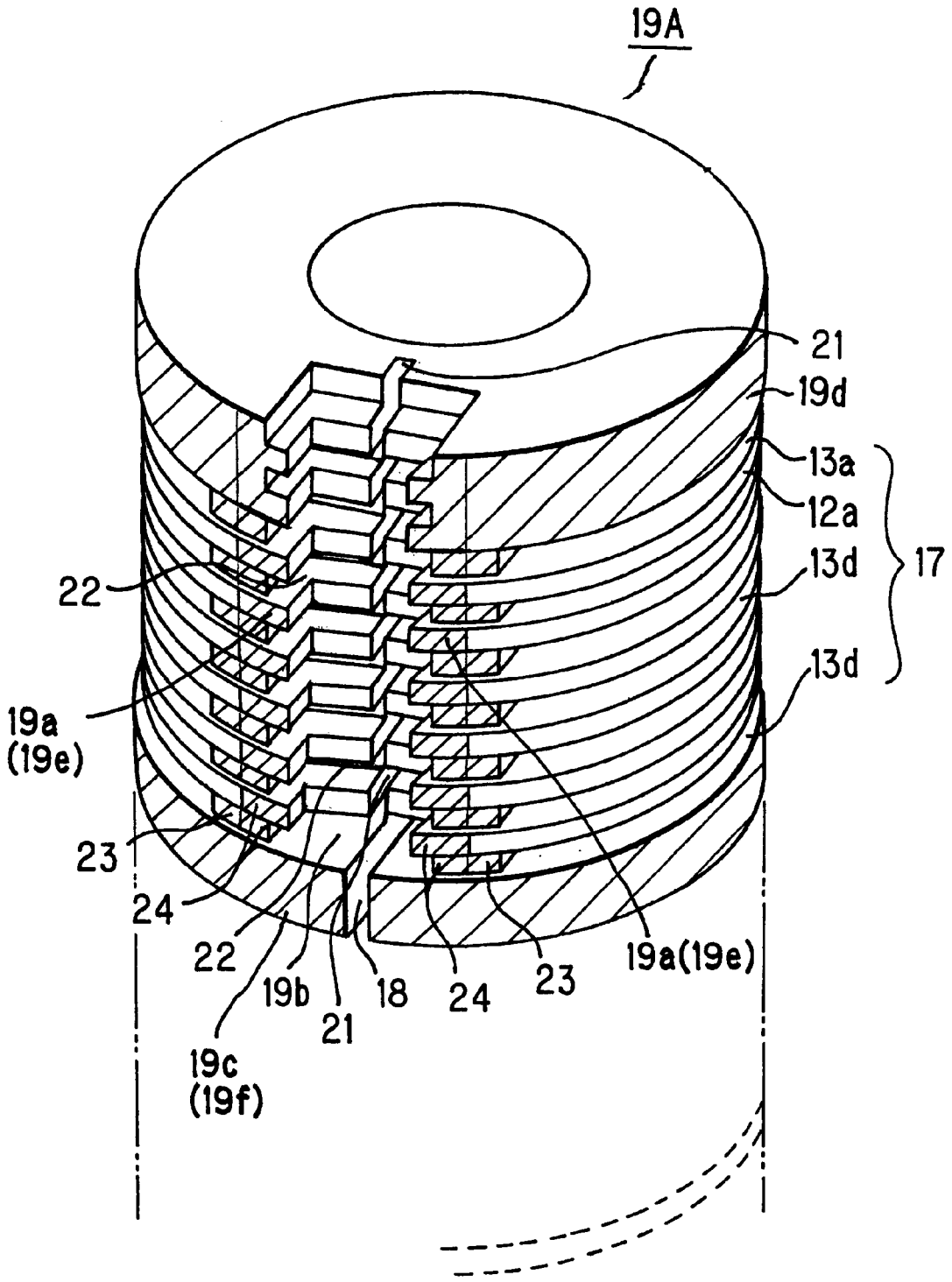
FIG. 2 is a perspective view showing an auxiliary retaining grooved portion in a collector according to the embodiment of the present invention.

Formed in the vicinity of element 18 is an enclosed portion 19*b* of the extended partitioning portion, which constitutes a channel that permits air bubbles entering by air replacement to move from air/liquid exchanger 18 to the ink tank 3 side (FIGS. 1 and 2).

Enclosed portion 19*b* is formed of a relatively wide groove, cutout or hole for permitting air bubbles arising from air replacement to move to the ink tank 3 side, and preferably has a configuration which is usually filled up with ink 2 when the writing instrument is put with its pen tip down. The enclosed portion 19*b* of the present embodiment is configured so as to form a space which gradually increases its depth in the radial direction of collector 6*a* as it approaches from the air/liquid exchanger 18 side to the ink tank 3 side. This arrangement of enclosed portion 19*b* so formed that the areas of opening become gradually greater from the air/liquid exchanger 18 side to the ink tank 3 side, enables air bubbles arising at air/liquid exchanger 18 to move to the ink tank 3 side more smoothly compared to the configuration where the areas of opening are made uniform.

Further, enclosed portion 19*b* is formed with lateral grooves 22 and a narrow groove 21 which leads ink 2 towards air/liquid exchanger 18.

Since narrow slit 21 provides almost the same functions, i.e., introduction and connection of ink 2, as narrow longitudinal groove 14 connected to main retaining groove section 16 does, it can be formed with dimensions and configuration similar to those of longitudinal groove 14, but may be formed by a cutout, hole or the like, defined by combination of parts as long as it can provide the function of leading ink 2 to extended partitioning portion 19*e*.

Further, in the present embodiment, in order to lead ink 2 from enclosed portion 19*b* to retaining grooves 13*a*, partitioning portion grooves 23 having almost the same width as retaining groove 13*a* are formed in extended partitioning portion 19*e* which is extended in the axial direction.

In order to lead ink 2 from narrow groove 21 to auxiliary retaining grooves 17 by way of partitioning portion grooves 23, lateral grooves 22 for connection between narrow groove 21 and partitioning portion grooves 23 are formed in enclosed portion 19*b*.

Lateral groove 22 may be formed by a groove, cutout, hole, clearance defined by a plurality of parts, or any other structure and shape, which provides the function of creating communication of ink 2 led from the ink tank 3 side via narrow groove 21 with auxiliary retaining grooves 17, as long as it can practically lead ink 2 to auxiliary retaining groove section 17.

Figure 3:
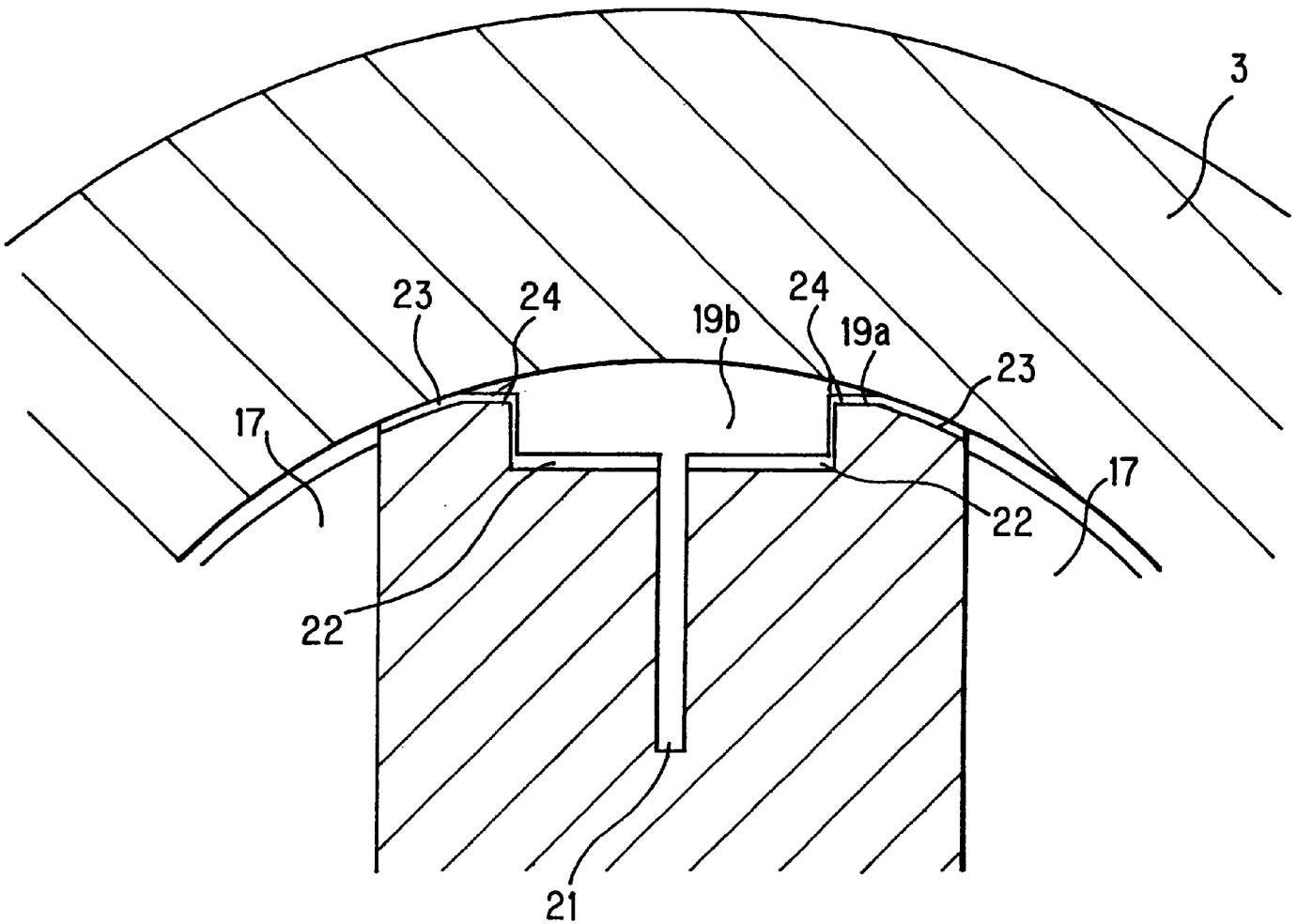
FIG. 3 is an illustrative view showing an enclosed portion 19*b* and its vicinity of the cross-sectional view cut along A–A' in FIG. 1.
Figure 4:
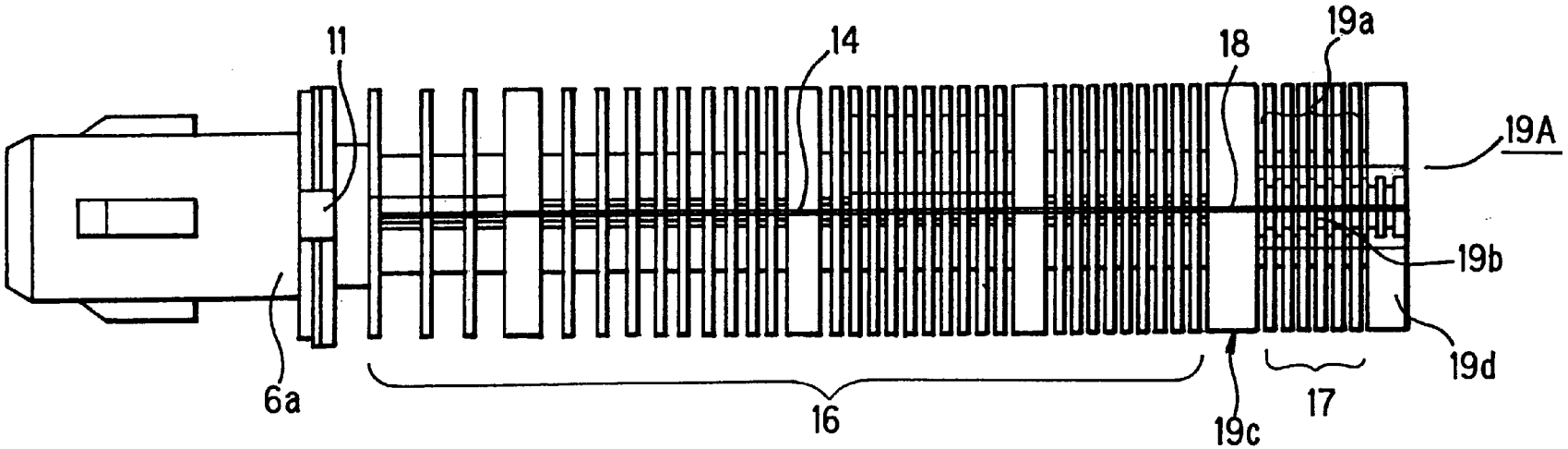
FIG. 4 is an appearance view showing a collector 6*a* according to the embodiment of the present invention.
Figure 5:
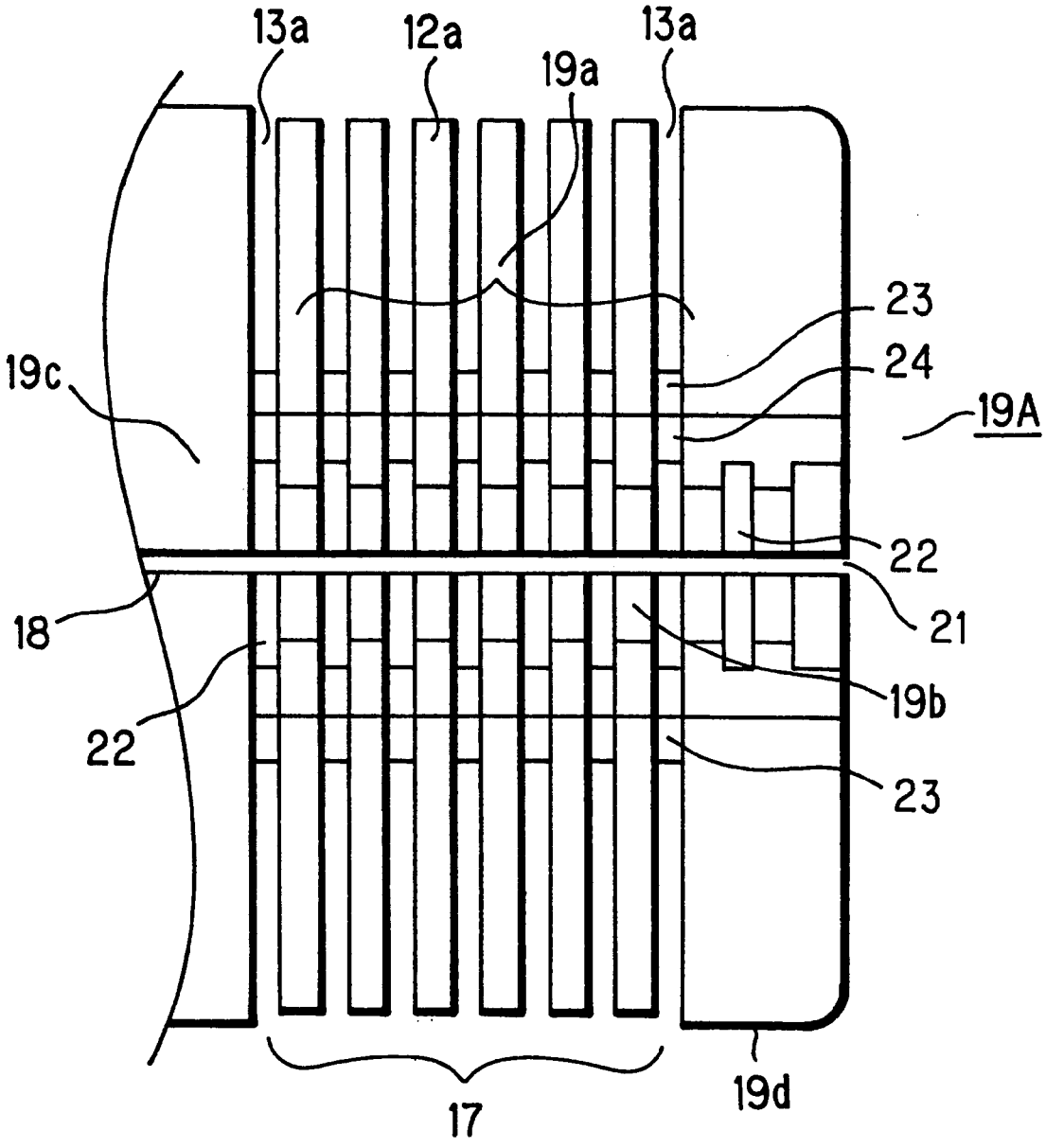
FIG. 5 is an enlarged appearance view showing the rear end side of an auxiliary retaining grooved portion in a collector according to the embodiment of the present invention.

Further, in the present embodiment, in order to make ink flow smoothly from the enclosed portion 19*b* side to the auxiliary retaining groove section 17 side, the edges of extended partitioning portion 19*a* are cut off so as to form chamfers 24, as shown in FIG. 3.

Chamfers 24 are formed so that the size of the opening becomes smaller as it goes from the enclosed portion 19*b* side to the auxiliary retaining grooves 17 side.

Figure 6:
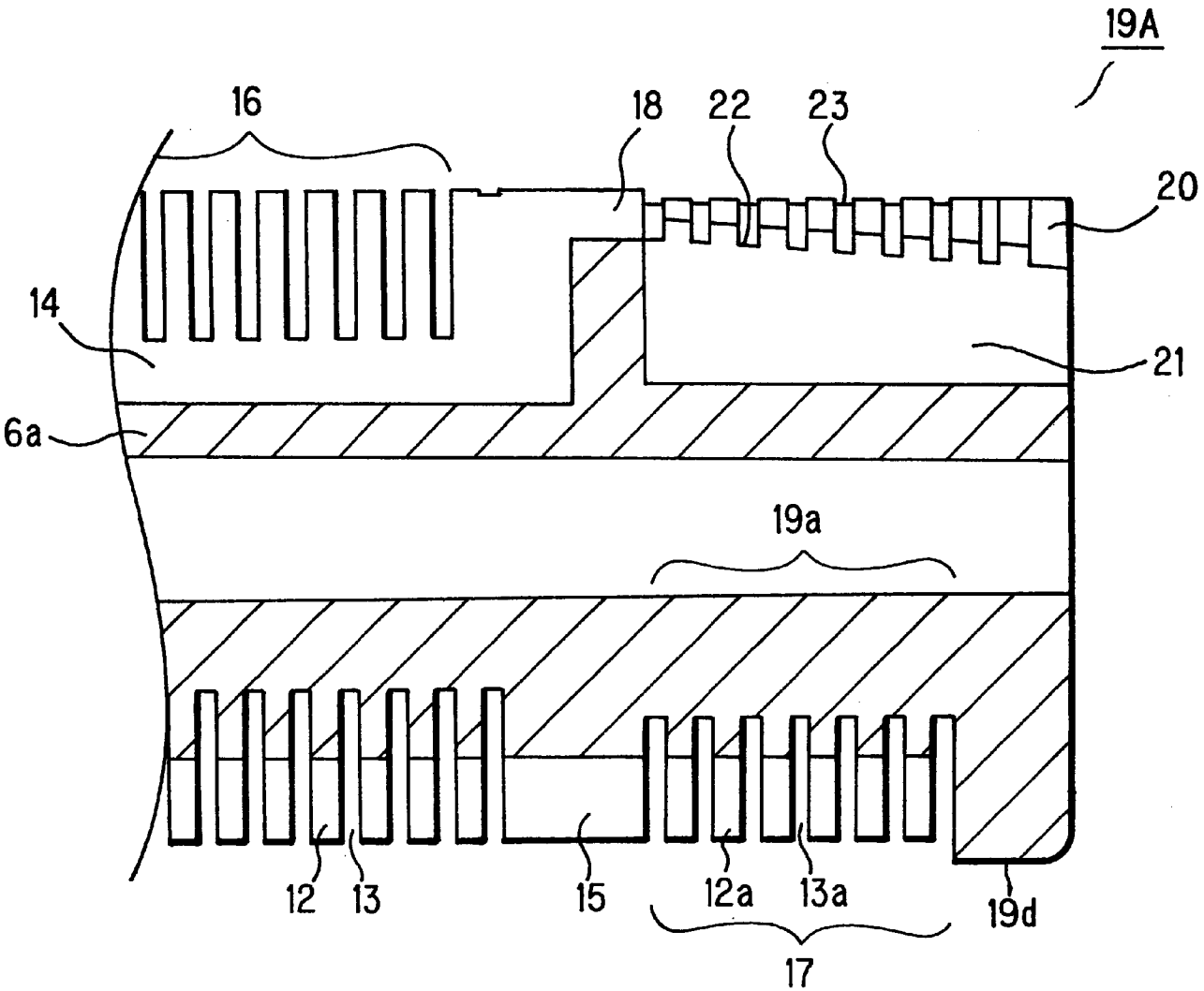
FIG. 6 is an enlarged vertical sectional view showing the rear end side of a collector 6*a* according to the embodiment of the present invention.

As shown in FIG. 6, both the auxiliary retaining grooves 17 and main retaining grooves 16 have air grooves 15 which are connected to the external air.

Each air groove 15 is arranged straight in the axial direction, or a certain number of vanes 12, 12*a* are cut out or grooved along their cross-section to create an air groove 15 which is arranged straight. Consecutive air grooves 15 are laid out so as to be bent or rotated a number of times (preferably three times or greater) so that the air passage will not be aligned (not shown). This configuration is effective when a sharp flush of ink would occur as in usage in an airplane.

In the conventional collector writing instrument, internal pressure adjustment is carried out by the collector 6 alone as already mentioned above, aiming at relatively gentle change in internal pressure due to changes in outside air temperature, or the like. However, as to conventional collector type writing instruments, careful consideration has not been given for the use under a reduced pressure state in an airplane or for the use under a sharp change in temperature such as a case where a writing instrument which has been put under winter ambient air is carried to the front of a heater. Since no countermeasures against a flush of ink 2 into collector 6 due to a sharp variation in pressure inside ink tank 3 has been taken, an inrush of ink 2 might run through air grooves 15 within collector 6 and flood out from air hole 10 of the pen body.

Even in the existing configuration, the collector type writing instruments are rather thick, so a thicker configuration will pose difficulties in gripping and appearance. If collector 6 is made longer than that of the conventional products, ink head H equivalent to the length of the collector 6 acts on point assembly 2, causing ink 2 to leak forward from tip 9 at the point assembly. If the capacity of ink tank 3 is reduced, it is possible to enhance the safety margin because the retaining ratio becomes greater with the same size of collector 6. However this poses the problem of making the writing life shorter. Since free-ink type writing instruments stably provide an ample amount of ink from the start of use until their writing life end, the same lifetime as pens of a sliver type which gradually reduce their ink consumption as they are used cannot be secured unless the former has a greater initial loaded amount of ink than the latter.

In the present invention, since auxiliary retaining grooves 17 are appended to main retaining grooves 16, the ink head H applied is the difference from air/liquid exchanger 18 to writing point 9 of point assembly 1. Since the ink head is the same as conventional collector typewriting instruments, no forward leakage, or ink leakage from writing point 9 will occur. The capacity of adjustment when the air space inside ink tank 3 expands or contracts, namely the maximum ink retention amount i of collector 6*a* is increased by the maximum ink retention amount ie of the auxiliary retaining grooves compared to the conventional configuration. Therefore, the resultant collector type writing instrument is improved in its capability to deal with variation in pressure and change in temperature.

In the case of use of a writing instrument in an airplane or under a situation with a sharp temperature variation, when the cap is opened and closed or when the cap is opened in the state in which the interior of ink tank 3 has been kept at a reduced pressure or pressurized state, ink may flow in rush into collector 6 or ink 2 retained in collector 6 cannot return to ink tank 3 and remains in collector 6, which will cause a flooding phenomenon upon a temperature rise or other events.

The ink lead and discharge arrangement, aiming at establishing communication between auxiliary retaining grooves 17 of the present invention and ink 2 inside ink tank 3, constituted by narrow groove 21, lateral grooves 22, partitioning portion grooves 23 and the like, enables ink 2 in ink tank 3 to flow into auxiliary retaining grooves 17 and main retaining grooves 16 of collector 6*a*, simultaneously if a sharp variation in pressure occurs. In sum, unlike the conventional configuration in which all ink 2 would flow in a rush and flood out by way of only air exchanger 18, ink may also flow into auxiliary retaining grooves 17, thus making it possible to alleviate the rushing flow.

In a conventional case, when a collector type writing instrument with ink 2 stored in retaining grooves 13 is uncapped under conditions in which the ink tank 3 is reduced in pressure compared to the atmosphere (for example, when a collector type writing instrument was used and then capped in an airplane during its flight at a high altitude and then the pen is uncapped on the ground; or when a collector type writing instrument was capped at a site elevated in temperature and then the pen is uncapped at another site low in temperature), the ink 2 held in retaining grooves 13 has to return in rush to ink tank 3 but air is drawn together into ink tank 3. As a result, the internal pressure reaches equilibrium while most ink 2 remains within retaining grooves 13. Thereafter, if the internal pressure in ink tank 3 is adjusted due to a change in temperature or other reasons, the problem of ink 2 exceeding the maximum retention capacity and flowing out from the writing instrument is liable to occur because the retaining grooves 13 have been already filled with ink 2. Particularly, this deficiency is liable to occur when sharp increase and reduction in pressure is repeated.

In the present invention, the arrangement of auxiliary retaining grooves 17, lateral grooves 22, partitioning portion grooves 23 and narrow groove 21 assures that ink 2 will flow into auxiliary retaining grooves 17 when a sharp reduction in external air pressure occurs as stated above, whereby it is possible to reduce the amount of ink flowing into main retaining grooves 16 as well as weakening the power of the rushing flow.

Moreover, when a sharp increase in external air pressure occurs, the ink 2 held in auxiliary retaining grooves 17 can return to ink tank 3 owing to the arrangement of auxiliary retaining grooves 17, lateral grooves 22, partitioning portion grooves 23 and narrow groove 21, in an easier manner than ink returns through air/liquid exchanger 18. Therefore, even if increase and decrease in pressure is further repeated, ink 2 can be retained and the ink retention capacity can be easily secured so that it is possible to increase the permissible margin against flooding.

In order to provide auxiliary retaining grooves 17 it is necessary to provide partitioning portion 19A. However, since partitioning portion 19A has a rather irregular configuration, there are cases where the collector end face may dry when the device is assembled or when it has been left with its tip up for a long period. In such a case, it happens that this part becomes difficult to be wetted with ink 2 immediately. In order to reliably wet this part with ink 2 and substantially shut off ink tank 3 from the external air, narrow groove 21 for leading ink and lateral grooves 22 connected to the narrow groove and partitioning portion grooves 23 to enable ink to reach auxiliary retaining grooves 17 are provided, whereby the entire partitioning portion 19A including connecting partitioning portions 19*a*, extended partitioning portion 19*e* and 19*f* gets wetted with ink 2 once narrow groove 21 gets wetted with ink 2.

In the embodiment of the present invention, each auxiliary retaining groove 13*a* has a width of about 0.05 mm (the distance with respect to the longitudinal direction of the writing instrument), which is equal to or smaller than that of the adequately fine longitudinal groove of air/liquid exchanger 18 (the distance with respect to the diametric direction of the writing instrument is about 0.1 to 0.15 mm) and is connected to associated partitioning portion groove 23.

Since, more or less, seven partitioning portion grooves 23 are formed, the total of their vertical sectional areas (the sum of the areas of the openings from the enclosed portion 19*b* to associated auxiliary retaining grooves 17) is greater than the cross-sectional area of air/liquid exchanger 18 (the area of the opening of air/liquid exchanger 18 to the enclosed portion 19*b* side).

Lateral groove 22 is formed to be approximately equal in width to auxiliary retaining groove 17, and narrow groove 21, lateral grooves 22, partitioning portion grooves 23 and auxiliary retaining grooves 17 are formed so as to permit ink 2 to communicate among themselves. Since partitioning portion groove 23 is sized to be smaller than air/liquid exchanger 18 in order that the former will produce a greater capillary capacity than the latter and since ink 2 is allowed to communicate, if ink tank 3 is reduced in pressure, ink 2, if any being held in auxiliary retaining grooves 17, moves first to the ink tank 3 side to adjust the internal pressure. Then, when the ink 2 in auxiliary retaining grooves 17 moves out, ink 2 or external air is led into ink tank 3 through air/liquid exchanger 18 while meniscuses remain forming at partitioning portion grooves 23.

Since partitioning portion 19A shuts off movement of air in and out between the outside and ink tank 3 and permits only ink 2 to move in and out and since multiple partitioning portion grooves 23 are provided so as to easily lead ink 2 therethrough rather than through air/liquid exchanger 18 which is formed alone, this arrangement provides improvement in the ability to cause ink 2 to move in and out when a sharp change in pressure occurs. This arrangement is particularly effective in preventing the problem that only air enters ink tank 3 upon a sharp pressure rise around the surroundings of the pen body when ink 2 remains in retaining grooves 13.

As an effective configuration of the present invention, the maximum ink retention 'is' of main retaining grooves 16 and the maximum ink retention 'ie' of auxiliary retaining grooves 17 are designed so as to satisfy a relation '$is>ie>0.05 \cdot is$'.

If the height of auxiliary retaining grooves 17 is taken to be too short, the effect to increase the collector capacity or the effect to return ink upon a sharp change in pressure cannot be obtained. In contrast, if the height of auxiliary retaining grooves 17 is taken to be too long, the area of partitioning portion 19A to be wetted upon assembly becomes large or, the size of main retaining grooves 16 should be made smaller to secure the capacity of ink tank 3. These are the possible drawbacks that were obtained.

As specific examples, various types of collectors 6*a* were formed to carry out trial and comparative experiments, using parts of a collector type writing instrument, UB-150, a product of MITSUBISHI PENCIL CO., LTD. The result is shown hereinbelow. All the other parts such as ink 2, the center core and other inner parts, were used from those of UB-150 which is sold on the market. Concerning the total length of collector 6*a* associated with the length of the writing instrument, since forward leakage occurred in comparative example 1, the height H of the air/liquid exchanger of collector 6*a* was set to be the same as the conventional collector 6, in the other trials thereafter. The vertical sectional area of each partitioning portion groove 23 was set to be half the cross-sectional area of air/liquid exchanger 18 while the others, that is, narrow groove 21, lateral groove 22 and the like were configured as in the illustrated example of the present invention.

The evaluation was made as to the following behaviors:

1. Flooding: resistance against flooding when the ambient temperature is varied from room temperature to about 50° C. in a state in which a greater air space is present with ink charged in ink tank 3 up to one third of its capacity 2. Forward leakage: whether or not forward leakage occurred from the writing tip under the same conditions as in "1" in the above
3. Wettability: stability of getting the partitioning portion wetted upon assembly The above three performances were graded with three levels ○(excellent), Δ(good) and ×(failure). The criteria of grading is as follows:

○(excellent): no flooding or no anomaly in wettability;
Δ(good): no problem for practical use but no safety margin;
×(failure): flooding or anomalies in wettability occurs.

Comparative Example 1

When the ink head H of the collector was set at 1.2 times of the conventional configuration (with no auxiliary retaining grooves).

Flooding: ○, Forward leakage: ×, Wettability: ○

Comparative Example 2

When 'is'='ie' (as the same result was obtained when 'is'<'ie', the description is omitted) Flooding: Δ, Forward leakage: ○, Wettability: ×

Comparative Example 3

When 'ie'=0.1·is Flooding: Δ to ×, Forward leakage: ○, Wettability: ○

EXAMPLE 1

When 'ie'=0.8·is Flooding: ○, Forward leakage: ○, Wettability: Δ

EXAMPLE 2

When 'ie'=0.5·is Flooding: ○, Forward leakage: ○, Wettability: ○

EXAMPLE 3

When 'ie'=0.2·is Flooding: Δ, Forward leakage: ○, Wettability: ○

Operation

The arrangement of the present invention not only provides the same function as conventional collector type writing instruments, i.e., prevention against ink flooding when the internal pressure varies in a relatively gentle manner with change in temperature, but also provides the function of weakening the flush of ink even if ink flows in rush into the collector from the ink tank side when an abrupt change in pressure occurs, in consideration of use on an airplane. Further, it has become possible to solve the problem relating to wetting the partitioning portion and extended partitioning portion with ink upon assembly.

Thus, the configuration of the present invention is able to totally prevent accidents of collector type writing instruments, including flooding and forward leakage.

Further, it is possible to provide a safe collector type writing instrument at low costs, by specifying the dimensions of the auxiliary retaining grooves so as not to produce a bad influence such as reduction of the capacity of ink tank 3 due to the presence of the auxiliary retaining grooves. Since it is possible to make effective use of the retaining grooves under any circumstances, this configuration will not produce an adverse effect on the effective function of adjustment and writing performance of a collector typewriting instrument.

Specifically, the auxiliary retaining grooves of the present invention make adjustment against sharp change in internal pressure. Partitioning portion grooves and the like formed so as to lead ink to the auxiliary retaining grooves are in charge of the function of facilitating ink to move in and out. The partitioning portion, extended partitioning portion and the like have the function of facilitating air bubbles entering by air replacement to release into the ink tank. The narrow groove has the function of leading ink smoothly from the ink tank and bringing ink via the lateral grooves so as to wet the partitioning portion and other components with ink.

Thus, as the configuration and functions of the writing instrument of the present invention are thus described, it is possible to provide a writing instrument which is slim and stylish and excellent in cost performance. It is also possible to suppress the occurrence of pumping phenomena resulting from capping, usage under varying pressure in an airplane and usage in an environment with change in temperature and hence secure safe and stable writing performance. In particular, it is possible to provide a writing instrument free from the flooding problem which would have occurred under conditions in which increase and reduction in pressure was repeated, such as in an airplane, as experienced by a business person who writes while traveling and who takes multiple flights.

Since the present invention is able to provide the effective functions as stated heretofore without needing any special change in metal mold structure and assembly method from the conventional collector type writing instrument configuration, it is possible to provide a collector writing instrument which can be easily manufactured at the same parts cost, and is inexpensive, stylish and excellent in preservation of long term performance.

INDUSTRIAL APPLICABILITY

The present invention can be applied to collector writing instruments which can be used under a varying pressure environment in an airplane or under an environment in which temperature changes. In particular, the present invention can be applied to writing instruments which are used under conditions in which increase and reduction in pressure is repeated, such as in an airplane, as experienced by a business person who writes while traveling and who takes multiple flights.

What is claimed is:

1. A so-called collector type writing instrument comprising:

a point assembly having a writing point at the front end thereof;

an ink tank for storing free-state, relatively low-viscosity ink having a viscosity of 2 to 100 mPa·s at normal temperature;

a feeder portion for feeding ink from the ink tank to the writing point; and a collector made up of a plurality of vane-like adjusting elements for adjusting the internal pressure of the ink tank by making use of capillary capacity and a longitudinal groove serving as an air/liquid exchanger groove and connected to the vane-like adjusting elements, characterized in that:

the collector has a partitioning portion comprised of a frontmost partitioning portion capable of shutting off air communication between the ink tank and an outside air other than through the air/liquid exchanger, a rearmost partitioning portion and connecting partitioning portions for connection between the frontmost partitioning portion and the rearmost partitioning portion;

main retaining grooves are formed from the frontmost partitioning portion toward the point assembly side;

auxiliary retaining grooves are formed between the frontmost partitioning portion and the rearmost partitioning portion;

air grooves connected to the outside air are formed in both the auxiliary retaining grooves and the main retaining grooves;

the air/liquid exchanger and a narrow groove for leading ink to the air/liquid exchanger are formed between the frontmost partitioning portion and the rearmost partitioning portion; and lateral grooves for leading ink from the narrow groove to the connecting partitioning portions are provided.

2. A so-called collector type writing instrument comprising:

a point assembly having a writing point at the front end thereof;

an ink tank for storing free-state, relatively low-viscosity ink having a viscosity of 2 to 100 mPa·s at normal temperature;

a feeder portion for feeding ink from the ink tank to the writing point;

a collector made up of a plurality of vane-like adjusting elements for adjusting the internal pressure of the ink tank by making use of capillary capacity and a longitudinal groove serving as an air/liquid exchanger groove and connected to the vane-like adjusting elements, characterized in that:

the collector has a partitioning portion including extended partitioning portion extended at least partly towards the point assembly side, the partitioning portion being capable of shutting off air communication between the ink tank and the outside air other than through the air/liquid exchanger;

main retaining grooves are formed from the extended partitioning portion toward the point assembly side;

auxiliary retaining grooves are formed around the extended partitioning portion, in the circumferential direction;

air grooves connected to the outside air are formed in both the auxiliary retaining grooves and the main retaining grooves; and the air/liquid exchanger and a narrow groove for leading ink to the air/liquid exchanger are formed in an enclosed portion which is enclosed by the extended partitioning portion while lateral grooves are formed for leading ink from the narrow groove to the extended partitioning portion.

3. The collector type writing instrument according to claim 2, wherein the extended partitioning portion has partitioning portion grooves connected to the auxiliary retaining grooves so that the narrow groove, lateral grooves, partitioning portion grooves and auxiliary retaining grooves permit ink to communicate between themselves.

4. The collector type writing instrument according to claim 1, wherein the connecting partitioning portions have partitioning portion grooves connected to the auxiliary retaining grooves so that the narrow groove, lateral grooves, partitioning portion grooves and auxiliary retaining grooves permit ink to communicate between themselves.

5. The collector type writing instrument according to claim 3 or 4, wherein a sectional area of each partitioning portion groove, cut in a longitudinal direction of the writing instrument is equal to or smaller than a sectional area of the air/liquid exchanger, sliced along the diametric direction of the writing instrument, and the total of all the vertical sectional areas of the individual partitioning portion grooves is designed to be greater than a cross-sectional area of the air/liquid exchanger.

6. The collector type writing instrument according to any one of claims 1 through 3, wherein the lateral grooves and auxiliary retaining grooves are formed so as to have approximately the same width with respect to the longitudinal direction of the writing instrument.

7. The collector type writing instrument according to claim 6, wherein a maximum ink retention 'ie' of the auxiliary retaining grooves and a maximum ink retention 'is' of the main retaining grooves are designed so as to satisfy a relation 'is>ie>0.05·is'.

8. The collector type writing instrument according to any one of claims 1 through 3, wherein a maximum ink retention 'ie' of the auxiliary retaining grooves and a maximum ink retention 'is' of the main retaining grooves are designed so as to satisfy a relation 'is >ie>0.05 is'.

9. The collector type writing instrument according to claim 5, wherein the lateral grooves and auxiliary retaining grooves are formed so as to have approximately the same width with respect to the longitudinal direction of the writing instrument.

10. The collector type writing instrument according to claim 9, wherein a maximum ink retention 'ie' of the auxiliary retaining grooves and a maximum ink retention 'is' of the main retaining grooves are designed so as to satisfy a relation 'is>ie>0.05·is'.

11. The collector type writing instrument according to claim 5, wherein a maximum ink retention 'ie' of the auxiliary retaining grooves and a maximum ink retention 'is' of the main retaining grooved are designed so as to satisfy a relation 'is>ie>0.05·is'.

* * * * *

UNITED STATES PATENT AND TRADEMARK OFFICE

CERTIFICATE OF CORRECTION

PATENT NO. : 6,602,012 B2
DATED : August 5, 2003
INVENTOR(S) : Kazuhiko Furukawa et al.

It is certified that error appears in the above-identified patent and that said Letters Patent is hereby corrected as shown below:

Column 18,
Lines 24 and 34, change “3” to -- 4 --.

Signed and Sealed this

Sixteenth Day of March, 2004

JON W. DUDAS
*Acting Director of the United States Patent and Trademark Office*